US011518418B2

(12) United States Patent
Moritzhuber

(10) Patent No.: US 11,518,418 B2
(45) Date of Patent: Dec. 6, 2022

(54) TYRE CONVEYOR FOR TRANSPORT MEANS

(71) Applicant: Innova Patent GmbH, Wolfurt (AT)

(72) Inventor: Johannes Moritzhuber, Hard (AT)

(73) Assignee: Innova Patent GmbH, Wolfurt (AT)

( * ) Notice: Subject to any disclaimer, the term of this patent is extended or adjusted under 35 U.S.C. 154(b) by 237 days.

(21) Appl. No.: 16/652,702

(22) PCT Filed: Oct. 9, 2018

(86) PCT No.: PCT/EP2018/077478

§ 371 (c)(1),
(2) Date: Apr. 1, 2020

(87) PCT Pub. No.: WO2019/076687

PCT Pub. Date: Apr. 25, 2019

(65) Prior Publication Data

US 2020/0290652 A1 Sep. 17, 2020

(30) Foreign Application Priority Data

Oct. 19, 2017 (AT) ..... A 50883/2017

(51) Int. Cl.

| | |
|---|---|
| ***B61B 12/02*** | (2006.01) |
| ***B61B 3/00*** | (2006.01) |
| ***B61B 10/02*** | (2006.01) |
| ***B61B 12/06*** | (2006.01) |

(52) U.S. Cl.

CPC ..... *B61B 12/022* (2013.01); *B61B 3/00* (2013.01); *B61B 10/02* (2013.01); *B61B 12/06* (2013.01)

(58) Field of Classification Search

CPC .... B61B 1/02; B61B 3/00; B61B 3/02; B61B 10/02; B61B 10/022; B61B 11/00; B61B 12/00; B61B 12/002; B61B 12/02; B61B 12/022; B61B 12/06; B61B 12/10

See application file for complete search history.

(56) References Cited

U.S. PATENT DOCUMENTS 4,100,809 A 7/1978 Bobrov et al.
4,210,019 A * 7/1980 Laurent ..... B61B 12/06 104/179
4,641,584 A 2/1987 Bertrand
(Continued)

FOREIGN PATENT DOCUMENTS

CN 101284539 A 10/2008
CN 102372005 A 3/2012
(Continued)

*Primary Examiner* — S. Joseph Morano
*Assistant Examiner* — Cheng Lin
(74) *Attorney, Agent, or Firm* — Laurence A. Greenberg; Werner H. Stemer; Ralph E. Locher

(57) ABSTRACT

The invention relates to a tire conveyor for a transport device, in particular gondolas, of a cable car installation. The conveyor includes tires, which are arranged along a track, and a drive train for the tires. The drive train has at least one drive pulley, in particular a belt pulley, and at least one drive device, in particular a belt. A guide is arranged along the track, at least in some sections, and at least one measurement device for measuring at least one property of the drive train or a component of the drive train is displaceable on the guide.

15 Claims, 3 Drawing Sheets

(56) References Cited

U.S. PATENT DOCUMENTS

| | | | | |
|---|---|---|---|---|
| 5,515,789 | A * | 5/1996 | Brochand | B61B 12/04 104/197 |
| 5,626,078 | A | 5/1997 | Fuchs | |
| 5,690,031 | A | 11/1997 | Bach et al. | |
| 7,802,523 | B2 | 9/2010 | Moritzhuber et al. | |
| 8,166,886 | B2 | 5/2012 | Thum | |
| 8,359,980 | B2 | 1/2013 | Beck | |
| 8,522,689 | B2 | 9/2013 | Beck | |
| 8,635,958 | B2 * | 1/2014 | Beck | B61B 12/002 104/117.1 |
| 8,660,698 | B2 * | 2/2014 | Phillips | H02G 1/02 700/259 |
| 9,873,439 | B2 | 1/2018 | Moritzhuber et al. | |
| 10,112,624 | B2 * | 10/2018 | Duer | B61B 12/105 |
| 10,370,007 | B2 * | 8/2019 | Graf | G01N 27/83 |
| 2008/0250964 | A1 | 10/2008 | Tamisier et al. | |
| 2016/0016594 | A1 * | 1/2016 | Trantina | G05D 1/0022 104/112 |

FOREIGN PATENT DOCUMENTS

| | | | | |
|---|---|---|---|---|
| CN | 102452399 | A | 5/2012 | |
| CN | 103100974 | A * | 5/2013 | B61B 7/00 |
| CN | 103100974 | A | 5/2013 | |
| CN | 103707891 | A | 4/2014 | |
| CN | 104097644 | A | 10/2014 | |
| CN | 106053591 | A | 10/2016 | |
| CN | 106061818 | A | 10/2016 | |
| DE | 2916913 | A1 | 11/1979 | |
| DE | 102008015035 | A1 | 9/2009 | |
| EP | 0770532 | A1 | 5/1997 | |
| EP | 2110290 | A2 | 10/2009 | |
| EP | 2110290 | A2 * | 10/2009 | B61B 12/06 |
| EP | 2441638 | A1 | 4/2012 | |
| EP | 3148858 | A2 | 4/2017 | |
| FR | 2340848 | A1 | 9/1977 | |
| JP | 2012516812 | A | 7/2012 | |
| JP | 2013139231 | A | 7/2013 | |
| KR | 20080092291 | A * | 10/2008 | B61B 12/06 |
| KR | 20170071304 | A | 6/2017 | |
| RU | 2145287 | C1 | 2/2000 | |
| RU | 2481212 | C2 * | 5/2013 | B61B 12/04 |
| RU | 2481212 | C2 | 5/2013 | |
| WO | 2015154106 | A1 | 10/2015 | |
| WO | 2015184478 | A2 | 12/2015 | |

* cited by examiner

TYRE CONVEYOR FOR TRANSPORT MEANS

BACKGROUND OF THE INVENTION

Field of the Invention

The invention relates to a tire conveyor for transport means, in particular vehicles, of a cableway system, comprising tires, which are arranged along a track, and comprising a drivetrain for the tires, which has at least one drive pulley, in particular a belt pulley, and at least one drive means, in particular a belt.

The invention further relates to a method for measuring at least one property of a drivetrain or of a component of the drivetrain.

Tire conveyors of the aforementioned type are known from, for example, EP 2 441 638 A1, EP 2 420 424 A1, EP 0 770 532 A1 and WO 2015/154106 A1.

In customary tire conveyors for cableway systems, which are operated with a high demand for constant availability and at the same time with short downtimes for maintenance work, it is necessary at periodic intervals to check the state of the drivetrain. This generally requires the presence on site of trained personnel who have to carry out measurements on the drivetrain while the tire conveyor is deactivated for safety reasons. An assessment based on the properties of the drivetrain that are determined by the measurements helps to estimate when maintenance work needs to be done on the drivetrain.

SUMMARY OF THE INVENTION

The object of the invention is to make available a tire conveyor of the aforementioned type that does not have the disadvantages of the prior art. In particular, an assessment of the state of a tire conveyor according to the invention is intended to be automated, preferably without the presence on site of a specialist, and with the tire conveyor continuing to operate.

This object is achieved, according to the invention, by a tire conveyor as claimed, and by a method as claimed.

Preferred and advantageous embodiments of the invention are the subject matter of the dependent claims.

According to the invention, provision is made that a guide is arranged along the track, at least in some sections, and that at least one measurement device for measuring at least one property of the drivetrain, or of a component of the drivetrain, is displaceable on the guide.

The measurement device can basically have all conceivable sensors and/or devices that permit a determination of properties of the drivetrain, or of individual components of the drivetrain, preferably by means of remote diagnosis.

From the measured values obtained by the measurement device and from data concerning the property or properties to be measured, conclusions can be drawn regarding wear and/or damage of the components of the drivetrain. In this way, maintenance and repair work can be planned in a targeted manner and can be carried out by specialists who have been chosen in advance and who have the appropriate tools and, if necessary, appropriate replacement parts. The downtimes of the cableway system, which are associated with such maintenance work, and the number of specialists used on site can thus be reduced and better estimated, as a result of which it is possible to make savings in terms of personnel and costs.

Further details, features and advantages of the invention will become clear from the following description and by reference to the accompanying drawings, in which preferred embodiments are shown. In the drawings:

DETAILED DESCRIPTION OF THE INVENTION

Figure 1:
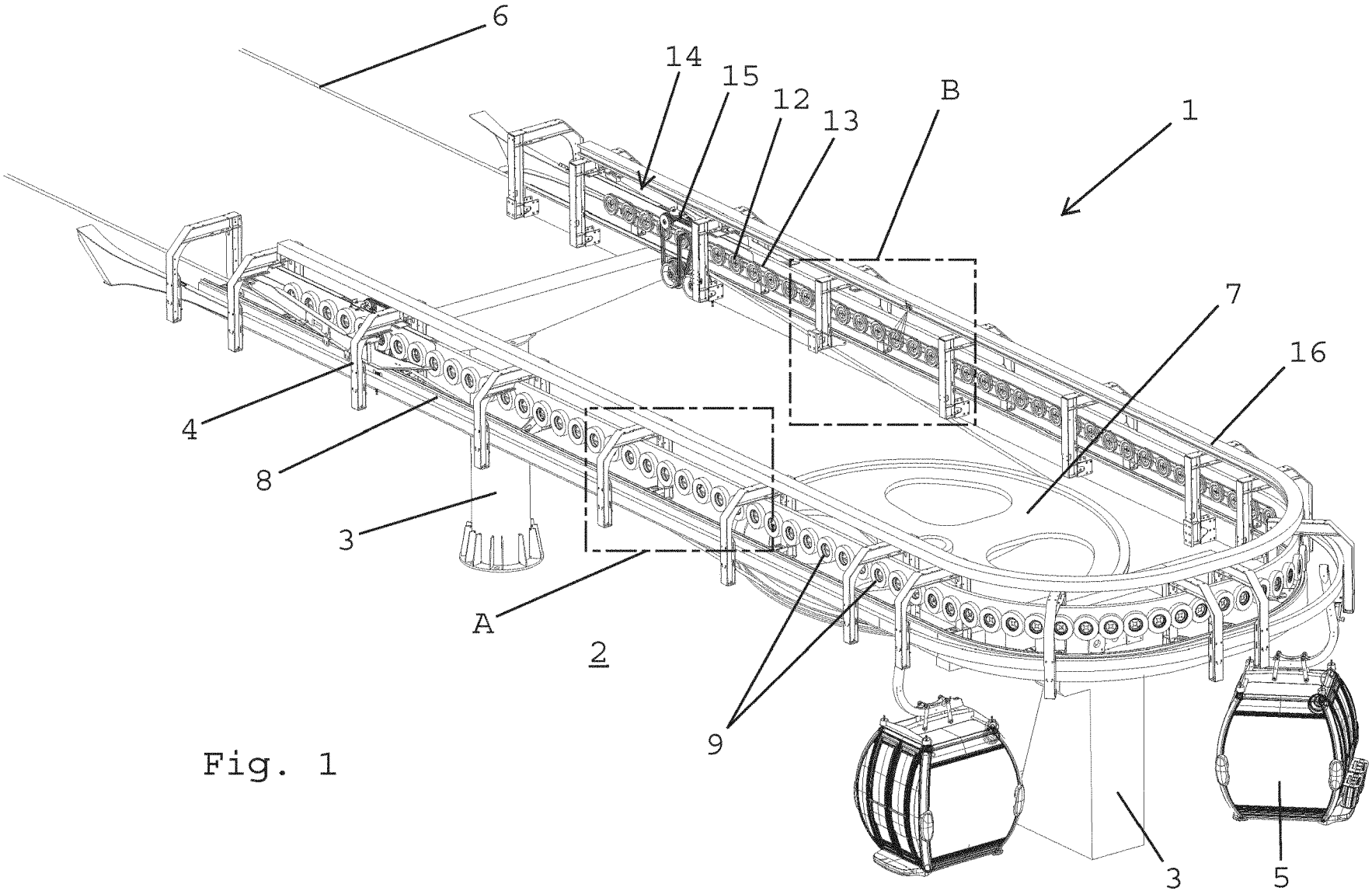
FIG. 1 shows an isometric view of a tire conveyor according to the invention.

FIG. 1 shows a tire conveyor 1 according to the invention in a station 2 of a cableway system, wherein the tire conveyor 1 is arranged on a supporting structure 4 mounted on stanchions 3.

As they enter the station 2, vehicles 5, for example cabins or chairs, are uncoupled from a carrying cable 6 and are conveyed through the station 2 by the tire conveyor 1. Since the station 2 shown in FIG. 1 is a terminus, the tire conveyor 1 has basically a U-shape, and the carrying cable 6 runs over a deflection pulley 7, by which it is deflected through 180°. However, an embodiment is also conceivable in which the tire conveyor 1 is arranged in an intermediate station of a cableway system and runs substantially rectilinearly.

Along a rail-shaped track 8, a plurality of tires 9, which run substantially parallel to the track 8 and are spaced apart from the latter, are arranged on a support 10 of the supporting structure 4. With the aid of the tires 9 of the tire conveyor 1, the vehicles 5 can be moved along the track 8 through the station 2.

Each tire 9 is connected to a respective shaft 11, which is mounted rotatably on the support 10 and has at least one drive pulley 12, for example a belt pulley. The drive pulleys 12 are driven via drive means 13, for example belts.

In each case two tires 9, or their drive pulleys 12, arranged one behind the other in the conveying direction are connected to each other via a drive means 13. In addition to the embodiments shown, in which drive pulleys 12 of exactly two tires 9 are connected via a drive means 13, embodiments are also conceivable in which drive pulleys 12 of three or more tires 9 are connected via a common drive means 13.

Drive pulleys 12 and drive means 13 are components of a drivetrain 14, for example a belt drive. As is shown in the embodiment illustrated, all the components of the drivetrain 14 are preferably coupled to one another. In the context of the invention, however, an embodiment is also conceivable in which individual tires 9 and/or groups of tires 9 are connected to subsystems of the drivetrain 14 that are decoupled from one another.

The invention is not limited to a belt drive as drivetrain 14 with belt pulleys as drive pulleys 12 and with V belts, V-ribbed belts or toothed belts as drive means 13. Other drive possibilities are also conceivable, for example a chain drive, with cogwheels as drive pulleys 12 and chains as drive means 13.

The drivetrain 14 is driven via a drive 15 shown in FIG. 1, for example an electric motor, as a result of which the tires 9 connected to one another via the drive means 13 of the drivetrain 14 are set in rotation.

Further details that can be applied in the context of the present invention, regarding the structure and the functioning of a tire conveyor according to the invention, can be found in EP 2 441 638 A1, EP 2 420 424 A1, EP 0 770 532 A1 or WO 2015/154106 A1.

Figure 2:
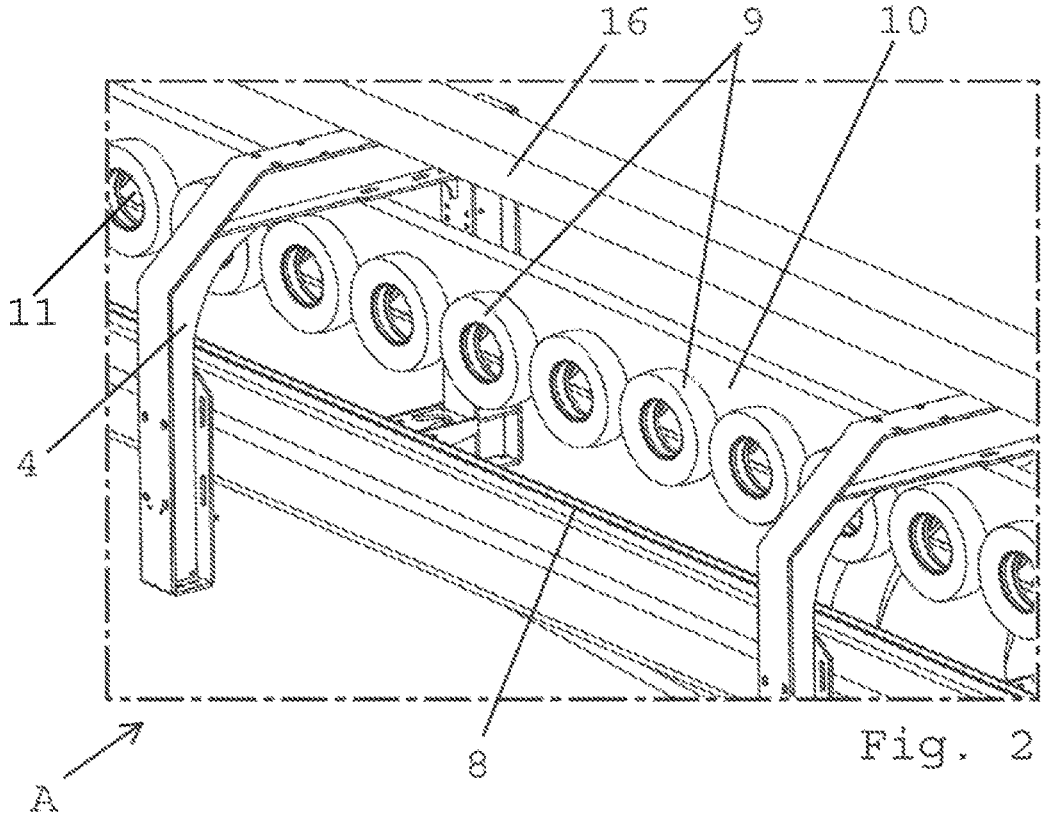
FIG. 2 shows an isometric detail A of the tire conveyor according to the invention shown in FIG. 1.
Figure 3:
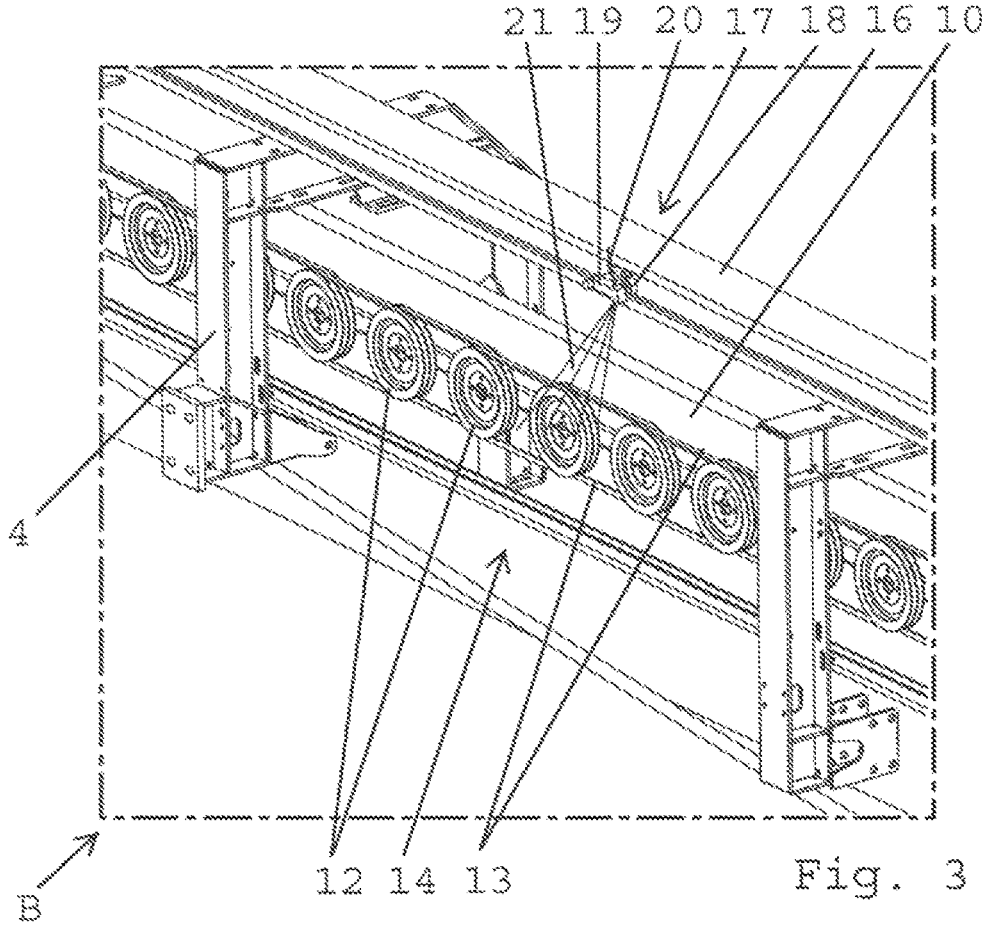
FIG. 3 shows an isometric detail B of the tire conveyor according to the invention shown in FIG. 1.

In the embodiment of the tire conveyor 1 according to the invention as shown in FIGS. 1, 2 and 3, a rail-shaped guide 16, on which a measurement device 17 is arranged, runs along the track 8 and above the support 10. In the context of the invention, the guide 16 can also be arranged or run behind, under or in front of the support 10. It is likewise conceivable that the guide 16 runs only along a partial section of the tire conveyor 1, or that a plurality of guides 16 with measurement devices 17 arranged thereon run along several partial sections of the tire conveyor 1.

The measurement device 17 is displaceable along the guide 16, and thus parallel to the track 8, to the tires 9 arranged on the support 10 and/or to the drivetrain 14, wherein the displacement of the measurement device 17 preferably takes place automatically. For this purpose, the measurement device 17, as shown in the figures, can be mounted in the guide 16 via rollers 18 and can be displaced or moved along the guide 16 by a cable pull or chain pull (not shown) engaging on the measurement device 17 or by a drive arranged on the measurement device 17 or integrated in the measurement device 17.

The measurement device 17 has at least one sensor 19, in particular an optical sensor, for detecting properties, in particular geometric properties and/or vibration properties, of the drivetrain 14, or of individual components of the drivetrain 14, such as drive pulleys 12 or drive means 13.

The detection or measurement of the properties can take place both statically and dynamically, with the drivetrain 14 stationary or driven, and at different positions on the guide 16 along the drivetrain 14.

In the context of the invention, an embodiment is also conceivable in which a plurality of measurement devices 17, which can also be equipped with different sensors 19, only if necessary, are arranged on a guide 16 and, either coupled to one another or decoupled from one another, are displaceable along the guide 16.

In the context of the invention, an embodiment (not shown) is also conceivable in which the measurement device 17 is arranged pivotably on the guide 16, for example via an arm, in order to align sensors 19 of the measurement device 17. Thus, for example, geometric properties of drive pulleys 12 and/or drive means 13 can be measured from different sides or viewing angles.

The measurement device 17 can be displaced along the guide 16, or pivoted on the guide 16, before, during and/or after the measurement.

In the context of the invention, a further embodiment is conceivable in which the measurement device 17 can also detect properties of the tires 9 and/or of the shafts 11 and/or of the track 8 and/or of the vehicles 5, in particular a suspension of the vehicles 5 arranged on the track.

Figure 4:
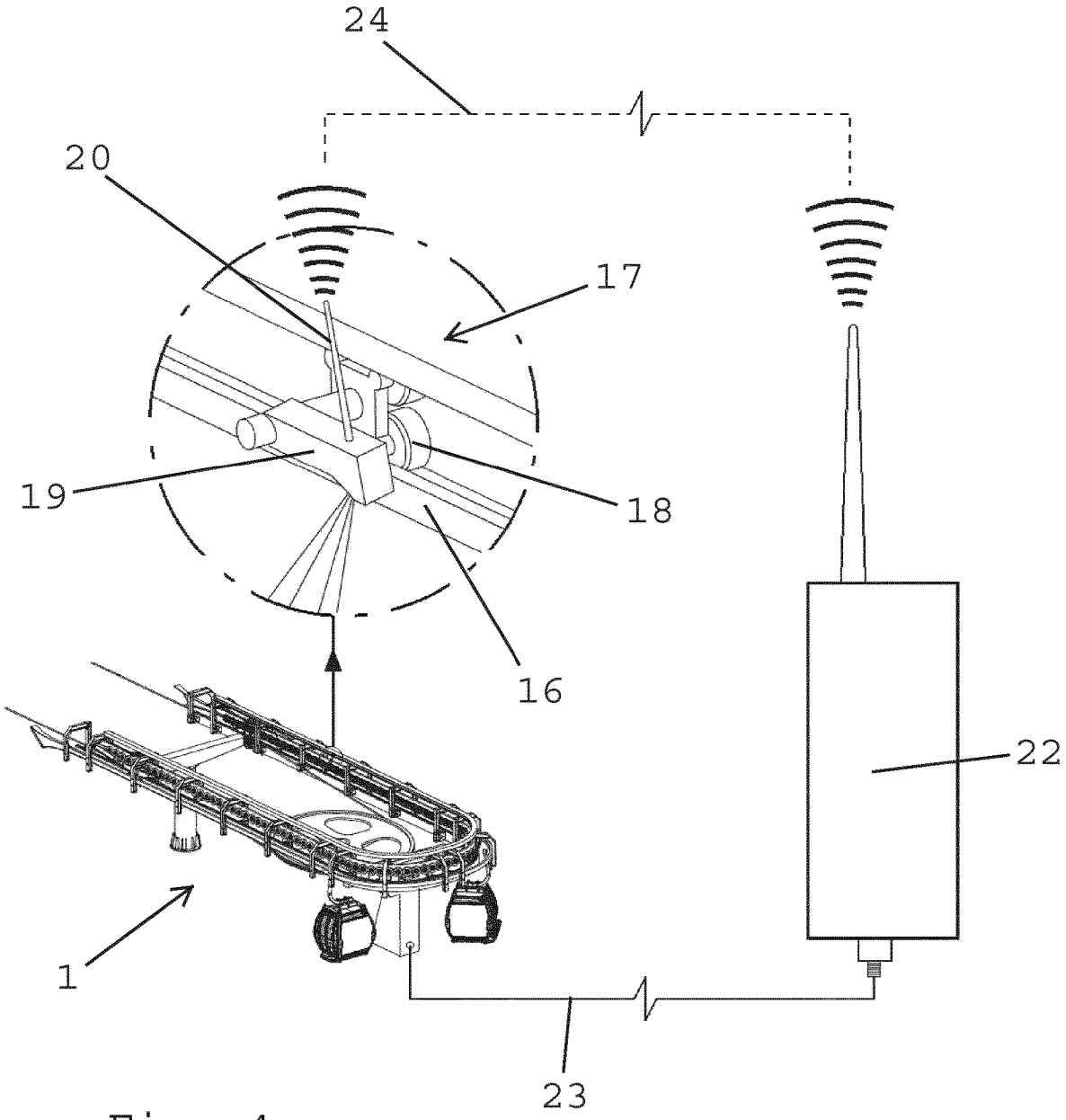
FIG. 4 shows a schematic view of a transmission of data between the tire conveyor according to the invention and a measurement station.

FIG. 4 shows a schematic view of a transmission of data between the measurement device 17, which is displaceable in the guide 16 via rollers 18 in the embodiment shown, and a measurement station 22 spatially separate from the measurement device 17.

For the transmission of data, the measurement device 17 preferably has a transmission unit by which measured values and data detected by the measurement device 17 and concerning properties measured by the sensor(s) 19 are transmitted to the measurement station 22. This transmission can be simultaneous or staggered and can be effected via a physical data conductor 23 and/or wirelessly, for example by a radio device with antenna 20 via a radio connection 24. The measured values and data can be transmitted to the measurement station 22 either in raw form or in a form already processed by means of a data processor integrated in the measurement device.

It is also conceivable that the measurement device 17, in particular in an embodiment of the measurement device 17 with integrated drive, is controllable via the transmission unit and is thus displaceable along the guide 16 externally and remotely.

For the measurement of geometric properties, the measurement device 17 preferably has a sensor 19 with a 2D/3D laser scanner. By means of a fanned laser beam 21, a laser line from this laser scanner is projected onto a surface to be measured, for example a surface of the drivetrain 14, e.g. in the region of a drive pulley 12 or onto a drive means 13, and is captured by a camera of the sensor 19 arranged at a triangulation angle. On the basis of the deviations of the captured laser line from a straight line, and on the basis of the known triangulation angle, it is thus possible to establish a two-dimensional height profile of the surface in the region of the laser beam 21.

By displacing the measurement device 17 along the drivetrain 14, by pivoting the measurement device 17 on the guide 16 and/or by driving the drivetrain 14, or individual components of the drivetrain 14 such as the drive pulleys 12 or the drive means 13, with the measurement device 17 stationary, a plurality of two-dimensional height profiles succeeding one another spatially and/or temporally can be established and can be combined by computer to form a three-dimensional surface profile.

It is likewise conceivable that sensors are arranged in the measurement device 17 in order to measure intensity, profile, frequency shift or phase shift and/or other properties of the projected and reflected laser beam 21, by means of which sensors it is possible to measure different properties of the drivetrain 14, or of individual components of the drivetrain 14, at different positions.

In the context of the invention, sensors 19 with two or more cameras spaced apart from each other can also be arranged on the measurement device 17, wherein the cameras each capture an image of the surface of the drivetrain 14, or of individual components of the drivetrain 14, from different viewing angles. On the basis of the known spatial arrangement of the cameras, these images can be used to establish by computer a three-dimensional surface profile.

The measurement device 17 can also have one or more sensors 19 acting as contactless distance meters, for example a laser triangulation sensor or an ultrasound sensor, one or more sound-sensitive sensors 19, such as a microphone, one or more temperature-sensitive sensors 19, one or more sensors 19 based on another measurement principle, or a combination of sensors 19 having different or identical actions.

If the drivetrain 14 is a belt drive with belt pulleys as drive pulleys 12 and belts as drive means 13, the properties that are detectable by the measurement device 17 comprise the following by way of example but not conclusively:

the belt geometry,
the belt tension,
the belt weight,
the belt vibration,
the geometry of belt pulleys,
the axial spacing of belt pulleys, the alignment of belt pulleys, the unbalance or radial runout of belt pulleys, and the speed of rotation of belt pulleys.

For example, in the case of a belt drive as drivetrain 14, the temporal change of the distance between measurement device 17 and belt can be measured in order to measure the frequency of the vibration of the belt, from which it is possible to calculate the tension or the weight of the belt.

The invention claimed is:

1. A tire conveyor for transport devices of a cableway system, the tire conveyor being disposed at a station or an intermediate station of the cableway system and comprising:

a supporting structure mounted on stanchions, and the tire conveyor being disposed on the supporting structure;

a plurality of tires arranged on a support of the supporting structure and along a track;

a drivetrain for driving said tires, said drivetrain having at least one drive pulley and at least one drive device;

a guide disposed along and separate from said track, at least in some sections thereof; and at least one measurement device for measuring a property of said drivetrain, or of a component of the drivetrain, said at least one measurement device being displaceably mounted on said guide.

2. The tire conveyor according to claim 1, wherein said drive pulley is a belt pulley and said drive device is a belt.

3. The tire conveyor according to claim 1, wherein said measurement device is mounted for automatic displacement.

4. The tire conveyor according to claim 3, wherein said measurement device is automatically displaceable by a cable pull engaging on said measurement device or by a drive arranged on said measurement device or integrated in said measurement device.

5. The tire conveyor according to claim 1, wherein said measurement device is configured to measure properties of said tires and/or of said drive pulleys and/or of said drive devices.

6. The tire conveyor according to claim 1, wherein said measurement device is configured to measure properties of said track and/or of the transport device.

7. The tire conveyor according to claim 1, wherein said measurement device is configured to measure geometric properties and/or vibrations.

8. The tire conveyor according to claim 1, wherein said measurement device comprises at least one sensor for dynamic 2D/3D profile detection.

9. The tire conveyor according to claim 8, wherein said at least one sensor is an optical sensor.

10. The tire conveyor according to claim 9, wherein said optical sensor is a laser scanner.

11. The tire conveyor according to claim 1, further comprising a transmission unit configured to transmit measured values detected by said measurement device and/or data concerning the measured properties to a measurement station via a data conductor and/or wirelessly.

12. The tire conveyor according to claim 1, wherein said measurement device is configured to measure properties on the driven drivetrain and/or on the stationary drivetrain.

13. The tire conveyor according to claim 1, wherein said measurement device is pivotably mounted on said guide.

14. The tire conveyor according to claim 13, wherein said measurement device is mounted for automatic pivoting.

15. A method for measuring a property of a drivetrain, or of a component of the drivetrain, of a tire conveyor at a station or an intermediate station of a cableway system, wherein the tire conveyor is disposed on a supporting structure mounted on stanchions, the tire conveyor has tires, which are arranged on a support of a supporting structure and along a track, and the drivetrain has at least one drive pulley and at least one drive device, the method comprising:

providing a guide disposed along and separate from the track, at least in some sections thereof; and displacing at least one measurement device for measuring the property of the drivetrain, or of the component of the drivetrain, along the guide.

* * * * *